US006693612B1

(12) United States Patent
Matsumoto et al.

(10) Patent No.: US 6,693,612 B1
(45) Date of Patent: Feb. 17, 2004

(54) LIQUID CRYSTAL DISPLAY APPARATUS AND ITS LUMINANCE CONTROL METHOD

(75) Inventors: Teruhiko Matsumoto, Ebina (JP); Takahiro Arakawa, Sagamihara (JP); Hidenobu Funaki, Hadano (JP); Masae Matsuura, Tsukui-gun (JP); Akihiro Mori, Zama (JP)

(73) Assignee: Hitachi, Ltd., Tokyo (JP)

( * ) Notice: Subject to any disclaimer, the term of this patent is extended or adjusted under 35 U.S.C. 154(b) by 43 days.

(21) Appl. No.: 09/712,146

(22) Filed: Nov. 15, 2000

(30) Foreign Application Priority Data

Nov. 18, 1999 (JP) ..... 11-327760

(51) Int. Cl.[7] ..... G09G 3/36

(52) U.S. Cl. ..... 345/87; 345/690; 345/699; 345/102; 348/602

(58) Field of Search ..... 345/87, 77, 84, 345/88, 90, 98, 102, 104, 214, 426, 204, 207, 690, 699; 348/602

(56) References Cited

U.S. PATENT DOCUMENTS 5,406,305 A * 4/1995 Shimomura et al. ..... 345/102
6,411,306 B1 * 6/2002 Miller et al. ..... 345/690

FOREIGN PATENT DOCUMENTS

JP 05-294918 * 11/1993 ..... G02F/1/133
JP 6-282240 10/1994
JP 7-146461 6/1995
JP 8-006522 1/1996
JP 09-287338 * 10/1997 ..... G06F/1/32
JP 11-119877 4/1999

* cited by examiner

*Primary Examiner*—Vijay Shankar
*Assistant Examiner*—Mansour M. Said
(74) *Attorney, Agent, or Firm*—Mattingly, Stanger & Malur, P.C.

(57) ABSTRACT

The information processing apparatus equipped with a liquid crystal display apparatus that is usable in the face-to-face usage style. When the display direction is switched into the facing direction and in a normal usage state, the liquid crystal display apparatus exhibits an excellent visual recognizability and complicated operations are unnecessary. The image information, the picture direction of which has been inverted upside down, is outputted from the information processing unit 2 to the display unit 1 in such a manner as to be coupled with the picture direction change instructing member 3. At the same time, the luminance information at the time of the picture upside-down inversion, which has been set in advance into the luminance adjusting member 4, is supplied to the display unit 1 so as to change the luminance simultaneously with the picture inversion. At this time, the luminance of the display unit 1 at the time of the picture upside-down inversion is changed to a higher luminance, thereby making it possible to enhance the visual recognizability from the facing side.

3 Claims, 6 Drawing Sheets

WHEN DISPLAY DIRECTION IS 0°-DIRECTION (AT THE TIME OF NORMAL USAGE)

WHEN DISPLAY DIRECTION IS 180°-DIRECTION (AT THE TIME WHEN PICTURE IS SHOWN TO FACING SIDE)

LIQUID CRYSTAL DISPLAY APPARATUS AND ITS LUMINANCE CONTROL METHOD

BACKGROUND OF THE INVENTION

1. Field of the Invention

The present invention relates to an information terminal apparatus with the liquid crystal display. More particularly, it relates to an information processing apparatus that is suitable for using face-to-face.

2. Description of the Prior Art

In an information processing apparatus such as a personal computer, as the display apparatus, there is used in many cases a liquid crystal display apparatus that is easy to downsize in the aspects of weight and outside appearance in comparison with the other types of display apparatuses. Such liquid crystal display apparatuses contain a built-in back-light and utilize its light as the light source, thereby implementing an enhancement of the visibility.

Basically speaking, one person has used the above-described information processing apparatus so far. In recent years, however, there has been appearing the usage style that two persons communicate in a state where they are face-to-face with each other. One example is a usage style that, when a business staff wishes to utilize a picture on the screen of the information processing apparatus for the presentation toward a client, the business staff and the client see the picture in the state of being face-to-face with each other. In that case, if a display direction of the picture in which a user normally looks at the picture is assumed to be 0° as is illustrated in FIG. 1A, a state where the display direction of the picture is inverted by the amount of 180° (FIG. 1B), i.e., the display direction of the picture is changed into the facing direction, allows the facing person to find it easier to see the picture.

However, in the liquid crystal display apparatuses used widely in general, there exists an optimum viewing angle. This condition results in a characteristic that, depending on the seeing angle, a contrast of the displayed content differs outstandingly. As a consequence of this characteristic, the ease with which the displayed picture can be seen has differed exceedingly, depending on the seeing angle or the seeing position toward the displayed picture.

As a solving method for this problem, JP-A-7-146461 has proposed and disclosed the following method: At the time of changing the display direction of the picture, a field-of-view angle setting voltage is switched and controlled so as to adjust the field-of-view angle, thereby making it easier to see the picture from the facing side as well.

Also, in a battery-driven portable type information processing apparatus, a power consumption by the display apparatus occupies a tremendous percentage out of a power consumption of the battery. In view of this situation, in many cases, a luminance of the display apparatus is set in advance to be a necessary minimum amount in order to reduce the power consumption. Moreover, in some information processing apparatus, there is performed a control that, depending on the operation state, sets a working condition of the display apparatus to be a power saving state.

The above-described method disclosed in JP-A-7-146461, however, necessitates a circuit for the field-of-view angle setting voltage that is not provided in the commonly used liquid crystal display apparatuses. This has made the liquid crystal display apparatuses special, becoming an obstacle against the provision of inexpensive liquid crystal display apparatuses.

Also, in the conventional information processing apparatus, there has existed the following problem: On account of the power saving control over the liquid crystal display apparatus or the information processing apparatus, the luminance of the liquid crystal display apparatus is varied or extinguished even when the display apparatus is used in the state where the display direction of the picture has been inverted by the amount of 180° in the use for the presentation and so on.

SUMMARY OF THE INVENTION

It is an object of the present invention to provide, at a low price, a display controlling apparatus that allows the facing person to find it easier to see the picture without the necessity of an additional circuit such as the above-described circuit for the field-of-view angle setting voltage.

Furthermore, it is another object of the present invention to provide a display controlling apparatus that sets an optimum working condition automatically between the normal usage state and the state where the display direction of the picture has been inverted by the amount of 180°. Namely, when, normally, one person uses the information processing terminal, he or she takes the driving time into consideration. Accordingly, in many cases, the one person sets the luminance of the liquid crystal display apparatus to be the necessary minimum amount, the power consumption by the liquid crystal display apparatus occupying the great deal of percentage out of the power consumption of the battery in the information processing terminal. When changing the picture direction in this state, since the luminance remains unchanged, the following operation becomes required: Especially when utilizing the picture for the presentation and so on and in changing the picture direction (by the amount of 180°) in order to show the picture to the person on the facing side, it becomes required to take the following operation into consideration: Increasing the luminance as high as possible to make the picture easy to see and to make a favorable impression on the facing person, and the like. However, a picture direction change instructing member and a luminance adjusting member are usually operated independently of each other. This condition requires an operator to adjust the luminance manually after changing the picture direction, thereby making the operation complicated. Also, in this case, when restoring the picture direction back to the original picture direction, the luminance that has been set at the time of inverting the picture direction (by the amount of 180°) continues to exist without being altered. This situation requires the operator to reset the luminance back to the original luminance at the time of the operation of restoring the picture direction back to the original one. In addition, if the operator should miss the resetting operation, the display apparatus will work still remaining in the higher luminance state against the operator, original intention. This situation increases the power consumption, eventually resulting in shortening the driving time of the battery.

In the present invention, in order to solve the above-described problem, a displayed picture upside-down inversion controlling member and the luminance adjusting member are caused to be operated in being coupled with each other so that, when the picture direction change instructing member instructs the displayed picture upside-down inversion controlling member to invert the display direction of the picture into the 180°-direction, the luminance of the display apparatus is caused to be automatically adjusted in such a manner as to be coupled together with the upside-down inversion of the displayed picture. This automatic adjustment, at the time of the inverted display, increases a light amount from the picture on the liquid crystal display apparatus, thus increasing a light amount toward the field-of-view in an oblique direction. As a result, the visual recognizablity becomes improved from the facing side as well, thereby being capable of making the field-of-view look enlarged than it really is.

Also, in order to solve the above-described another problem, there is provided a storing member for latching the set luminance value of the displayed picture, thereby storing the set luminance value of the displayed picture before being inverted by the amount of 180°. Thus, when restoring the displayed picture back to the normal usage state (i.e., 0°-direction), the luminance of the displayed picture is restored and reset by referring to the value stored in the storing member for latching the set luminance value.

Also, in order to solve the above-described still another problem, the displayed picture upside-down inversion controlling member, the luminance adjusting member and a power saving controlling unit are caused to be operated in being coupled with each other. As a consequence, when inverting the displayed picture by the amount of 180°, the operation of the power saving controlling unit is prohibited from lowering at least the picture luminance (the power saving controlling unit is caused to be operated in such a manner that it will not lower at least the picture luminance). Moreover, when restoring the displayed picture back to the normal usage state (i.e., 0°-direction), the operation of the power saving controlling unit is also restored back to its original working condition.

DESCRIPTION OF THE EMBODIMENTS

Figure 1A:
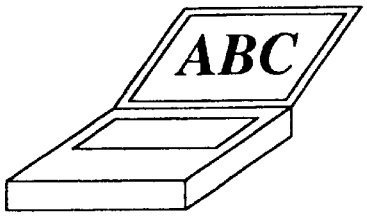
PRIOR ART FIG.1A
FIG. 1A illustrates the display example at the time of the normal usage (the display direction is the 0°-direction)
Figure 1B:
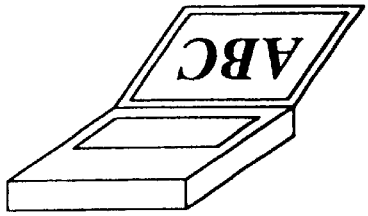
PRIOR ART FIG.1B
FIG. 1B illustrates the display example at the time of the face-to-face usage (the display direction is the 180°-direction)
Figure 2:
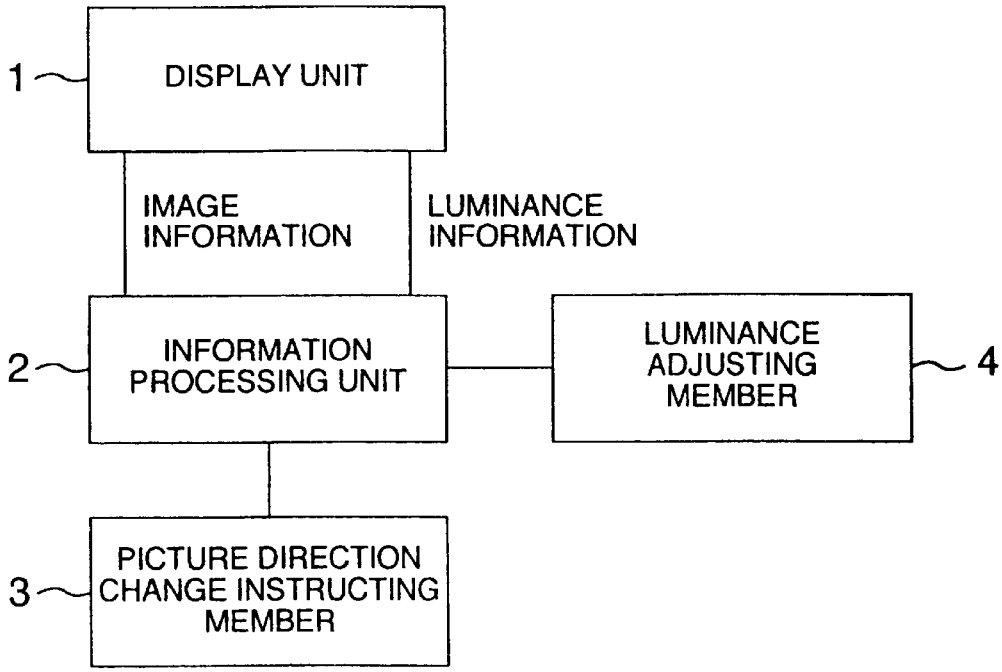
FIG. 2 is a block diagram for illustrating an embodiment according to the present invention.

FIG. 2 is a block diagram for illustrating the 1st embodiment of an information processing apparatus according to the present invention. The 1st embodiment indicates the case where the present invention has been applied to a portable type information processing apparatus such as a notebook personal computer. The information processing apparatus includes a display unit 1, an information processing unit 2, a picture direction change instructing member 3, and a luminance adjusting member 4. Based on information conveyed from the picture direction change instructing member 3 and the luminance adjusting member 4, the information processing unit 2 communicates image information and luminance information to the display unit 1 so as to cause the display unit to execute a predetermined display.

Explaining the present embodiment in more detail, it is characterized by a processing at the time when an instruction by the picture direction change instructing member 3 of changing the picture direction to the facing side, i.e., the 180°-direction, is inputted into the information processing unit 2. The information processing unit 2 receives the picture direction changing instruction from the picture direction change instructing member 3, then outputting, to the display unit 1, the image information resulting from inverting the picture direction into the 180°-direction. Simultaneously with this, the information processing unit 2 outputs, to the display unit 1, the luminance information at the time of the 180°-direction set by the luminance adjusting member 4. On account of this, when the user directs the picture on the display apparatus to the facing person side and instructs the 180°-inversion of the displayed picture, it becomes possible to change the luminance to a higher luminance. This condition increases a light amount toward the field-of-view in an oblique direction, thereby enhancing the visual recognizablity from the facing side as well. Concerning the case of restoring the picture direction back to the original one, in much the same way as the above-described case, when the picture direction change instructing member 3 issues an instruction of changing the picture direction to the 0°-direction, the information processing unit 2 also supplies, to the display unit 1, the image information in which the picture direction has been restored back to the 0°-direction. Simultaneously with this, the information processing unit 2 outputs, to the display unit 1, the luminance information at the time of the 0°-direction set by the luminance adjusting member 4.

Especially when such persons as a business staff make a presentation and the like, the above-described embodiment permits the business staff to perform the following: Directing the displayed picture into the direction of the facing person and inverting the display direction into the 180°-direction, and at the same time setting the display luminance to be a higher value. Accordingly, it becomes possible to enhance the visual recognizablity of the picture, thus making a strong impression on the facing person.

Figure 3:
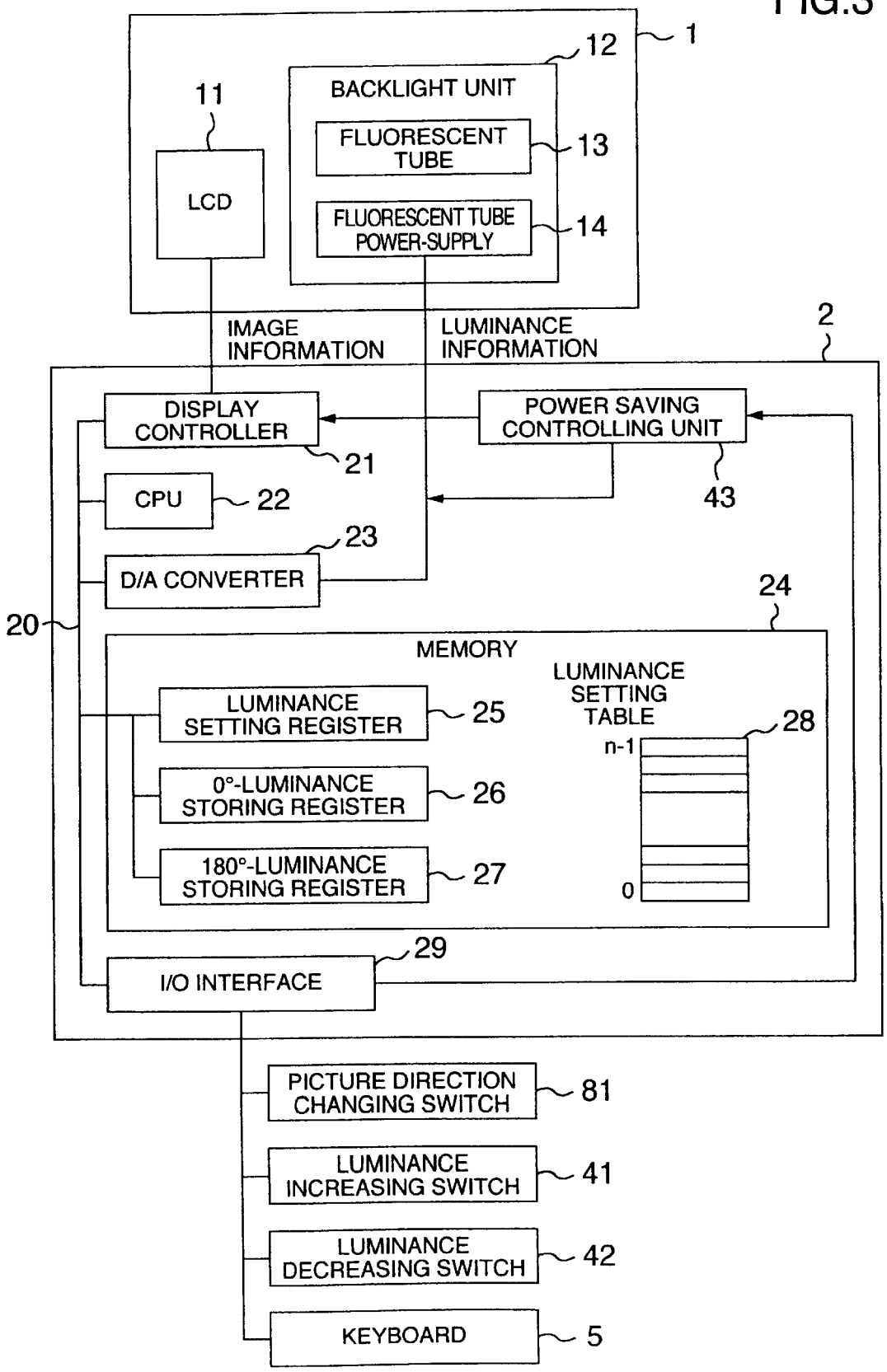
FIG. 3 another block diagram for illustrating an embodiment according to the present invention.

FIG. 3 is a block diagram for illustrating the 2nd embodiment of an information processing apparatus according to the present invention. The 2nd embodiment indicates the case where the present invention has been applied to an information processing apparatus having a liquid crystal display apparatus that uses a backlight unit and a LCD. In FIG. 3, a display unit 1 includes the LCD 11 and the backlight unit 12. The backlight unit 12 has a fluorescent tube 13 and a fluorescent tube power-supply 14. The fluorescent tube power-supply 14 has a function of adjusting a luminance of the fluorescent tube in accordance with the luminance information in an analogue voltage. An information processing unit 2 includes a display controller 21, a CPU 22, a D/A converter 23, a memory 24 and an input/output (I/O) interface 29, all of which are connected with each other by a bus 20. Also, a luminance setting register 25, a 0°-luminance storing register 26 and a 180°-luminance storing register 27, which are storage members for storing the luminance information of the LCD 11, are stored in a portion of the memory 24. The luminance setting register 25 indicates the luminance information of the LCD 11 at a present point in time. The 0°-luminance storing register 26 stores the luminance information at the time when the picture direction is the 0°-direction, and the 180°-luminance storing register 27 stores the luminance information at the time when the picture direction is the 180°-direction. Moreover, the memory 24 also stores a luminance setting table 28, which stores n pieces of luminance information. Incidentally, a power saving controlling unit 43 is a processing unit for performing a power saving control over the display unit 1 and the information processing unit 2. The power saving controlling unit is a portion not related with the present embodiment.

Figure 4:
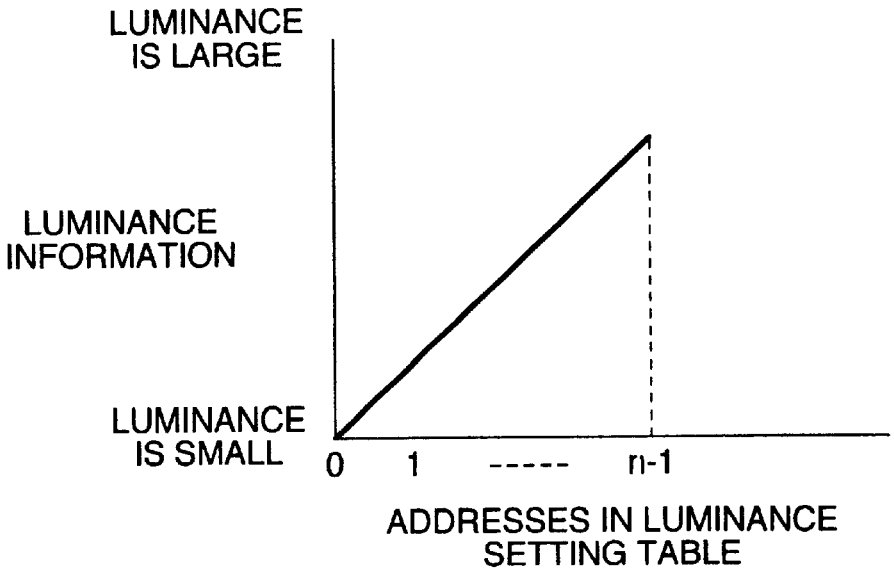
FIG. 4 is a diagram for showing a correspondence between a set luminance value and a luminance of the display apparatus in the embodiments according to the present invention.
Figure 5:
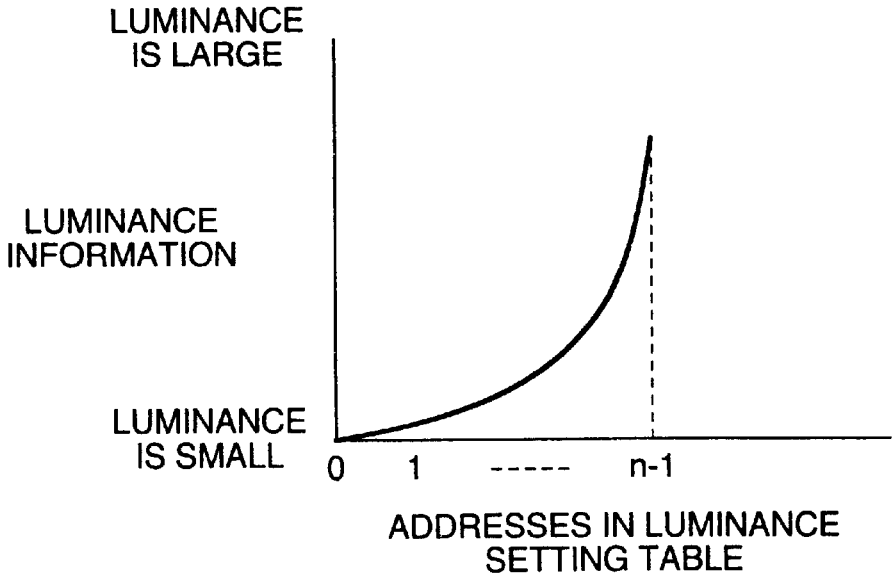
FIG. 5 is a diagram for showing another correspondence between the set luminance value and the luminance of the display apparatus in the embodiments according to the present invention.

Here, FIG. 4 indicates the relationship between the stored information and the actually outputted luminances. Luminance information stored at an address 0 is the information at the time of the minimum luminance, and luminance information stored at an address n−1 is the information at the time of the maximum luminance. Incidentally, although, in FIG. 4, the correlation relationship between the addresses in the luminance setting table and the luminances is a linear relationship, the nonlinear correlation relationship is also allowable as is illustrated in FIG. 5.

The D/A converter 23 illustrated in FIG. 3 is connected to the fluorescent tube power-supply 14 so as to supply the luminance information in the analogue voltage to the fluorescent tube power-supply 14, thereby controlling the luminance of the fluorescent tube 13. The LCD 11, which is connected to the display controller 21, performs the display in accordance with the image information obtained from the display controller 21. Furthermore, the I/O interface 29 is connected to a luminance increasing switch 41, a luminance decreasing switch 42, a picture direction changing switch 31 and a keyboard 5. Information inputted from the keyboard 5 or an external apparatus is supplied to the CPU 22 through the I/O interface 29. The image information is supplied from the CPU 22 to the LCD 11 through the display controller 21. Also, a luminance changing instruction inputted from the luminance increasing switch 41 and the luminance decreasing switch 42 is supplied to the CPU 22 through the I/O interface 29. Also, information from the picture direction changing switch 31 is similarly supplied to the CPU 22 through the I/O interface 29. When receiving the picture direction changing instruction, the CPU 22 issues the picture direction changing instruction to the display controller 21. Then, the display controller 21 supplies, to the LCD 11 as the image information, the image resulting from inverting the upside-down direction of the picture by the amount of 180°. At this time, every time the picture direction changing switch 31 is pushed down, the CPU 22 issues the picture direction changing instruction to the display controller 21. Consequently, it turns out that, as an operation, the picture direction is interchanged between 0° and 180° every time the picture direction changing switch is operated just one time.

Next, the explanation will be given below concerning a method of adjusting the luminance of the display unit 1. The D/A converter 23 is connected to the bus 20, and the CPU 22 sets, into the D/A converter 23, the data content stored in the luminance setting register 25. The D/A converter 23 converts the set data content into the analogue voltage, then supplying, as the luminance information, the analogue voltage to the fluorescent tube power-supply 14. Here, in the case where the luminance increasing switch 41 and the luminance decreasing switch 42 issue the luminance changing instruction, the CPU 22 reads, into the luminance setting register 25, the content at an address in the luminance setting table 28 which corresponds to the luminance change, then setting the content into the D/A converter 23. The D/A converter 23 supplies, to the fluorescent tube power-supply 14 as luminance information, an analogue voltage generated based on the new luminance information read into the luminance setting register 25. The above-described processing makes it possible to adjust the luminance.

Figure 6:
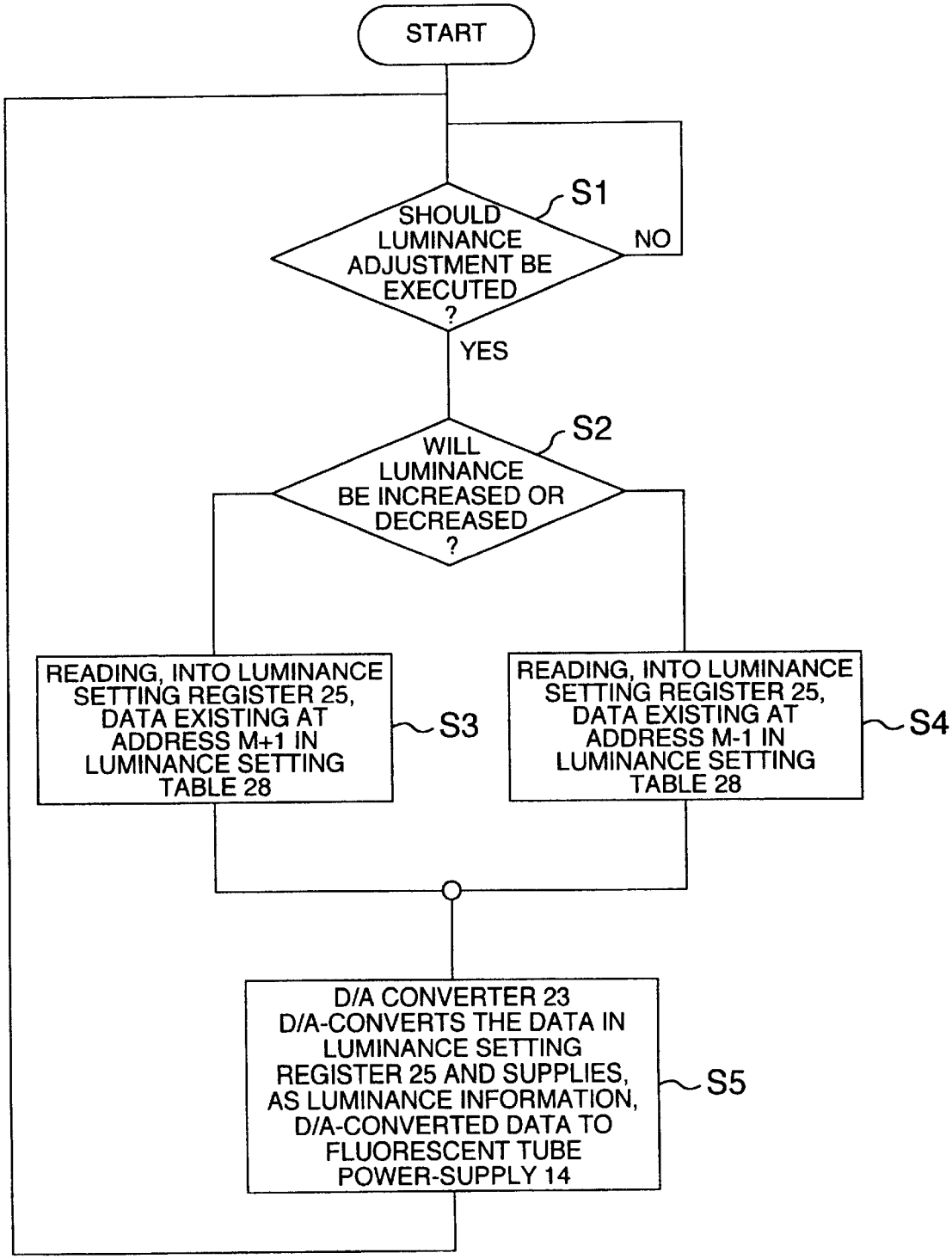
FIG. 6 is a flow chart for explaining a luminance adjustment processing in the embodiments according to the present invention.

FIG. 6 is a flow chart for explaining the above-described processing of adjusting the luminance. Incidentally, it is assumed that the content in the luminance setting register 25 before the luminance change is data existing at an address m in the luminance setting table. First, at a step Si, the judgement is performed as to whether or not the luminance changing instruction has been executed. If no instruction has been executed, go back to the step S1. If the changing instruction has been issued, at a step S2, it is judged whether the instruction comes from the luminance increasing switch 41 or from the luminance decreasing switch 42. If the instruction comes from the luminance increasing switch 41, going to a step 3, data existing at an address m+1 in the luminance setting table 28 is read into the luminance setting register 25. If the instruction comes from the luminance decreasing switch 42, going to a step 4, data existing at an address m−1 in the luminance setting table 28 is read into the luminance setting register 25. This processing makes it possible to increase or to decrease the luminance by one stage. After the processing at the step 3 or the step 4 has been performed, the processing goes back to the step S1. It is needless to say that the index m in the luminance setting table is updated when the luminance adjustment has been executed.

Next, returning back to FIG. 3, the explanation will be given below concerning the inversion operation of the displayed picture. When the picture direction changing switch 31 issues the changing instruction of changing the picture direction to the 180°-direction, the changing instruction is supplied to the CPU 22 through the I/O interface 29. The CPU 22 issues the picture direction inverting instruction to the display controller 21, and at the same time stores the content in the luminance setting register 25 into the 0°-luminance storing register 26. Moreover, the CPU 22 sets the content in the 180°-luminance storing register 27 into the luminance setting register 25. Since the D/A converter 23, based on the content in the luminance setting register 25, outputs the luminance information to the fluorescent tube power-supply 14, the luminance is changed to the luminance that had been stored in the 180°-luminance storing register 27. By the way, pushing down the picture direction changing switch 31 performs these processings simultaneously. As a result, when the user performs the picture direction changing instruction, it becomes possible to change the luminance to the value that had been set in advance into the 180°-luminance storing register 27.

Figure 7:
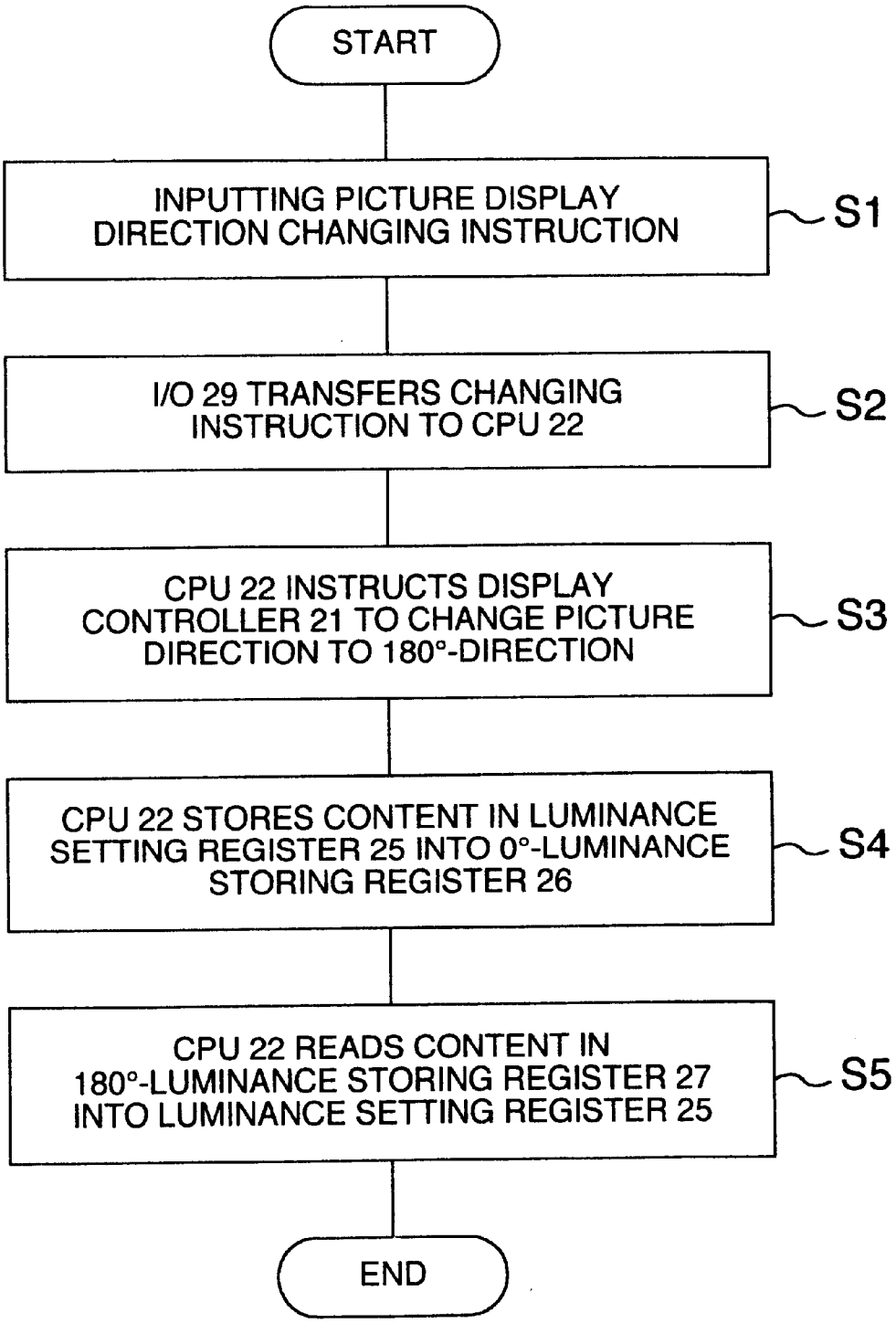
FIG. 7 is a flow chart for explaining the luminance adjustment processing at the time of the 180°-inversion display in the embodiments according to the present invention.

FIG. 7 is a flow chart for explaining the above-described processing of the inversion operation. When, at a step S1, the picture direction changing switch 31 issues the picture direction changing instruction, at a step S2, the I/O 29 transfers the changing instruction to the CPU 22. At a step S3, the CPU 22 issues, to the display controller 21, the instruction of outputting the image information resulting from changing the picture direction to the 180°-direction. At a step S4, the CPU 22 stores the content in the luminance setting register 25 into the 0°-luminance storing register 26. Finally, at a step S5, the CPU 22 reads the content in the 180°-luminance storing register 27 into the luminance setting register 25. Eventually, this procedure changes the picture direction to the 180°-direction, and at the same time changes the luminance to the content that had been stored in the 180°-luminance storing register 27.

Incidentally, the luminance information that had been stored in the 180°-luminance storing register is the luminance that the user had adjusted when switching the picture direction into the 180°-direction. Accordingly, it turns out that the luminance is switched into the luminance that the user had adjusted so that the facing person finds it easier to see the picture.

Here, it is preferable that a high luminance value suitable for the 180°-inversion display had been stored in the 180°-luminance storing register 27.

Next, using FIG. 3, the explanation will be given below concerning the case where the user has performed an instruction of changing the picture direction from the 180°-direction to the 0°-direction. The CPU 22 issues, to the display controller 21, the instruction of changing the picture direction to the 0°-direction, and at the same time stores the content in the luminance setting register 25 into the 180°-luminance storing register 27. Next, the CPU 22 sets, into the luminance setting register 25, the luminance information before the inversion which had been stored in the 0°-luminance storing register 26. Based on the luminance information before the inversion which has been set into the luminance setting register 25, the D/A converter 23 supplies, to the fluorescent tube power-supply 14, luminance information in an analogue voltage which corresponds to the luminance information before the inversion. The above-described processing, when restoring the picture direction back to the 0°-direction state, makes it possible to restore the luminance as well back to the original state.

Figure 8:
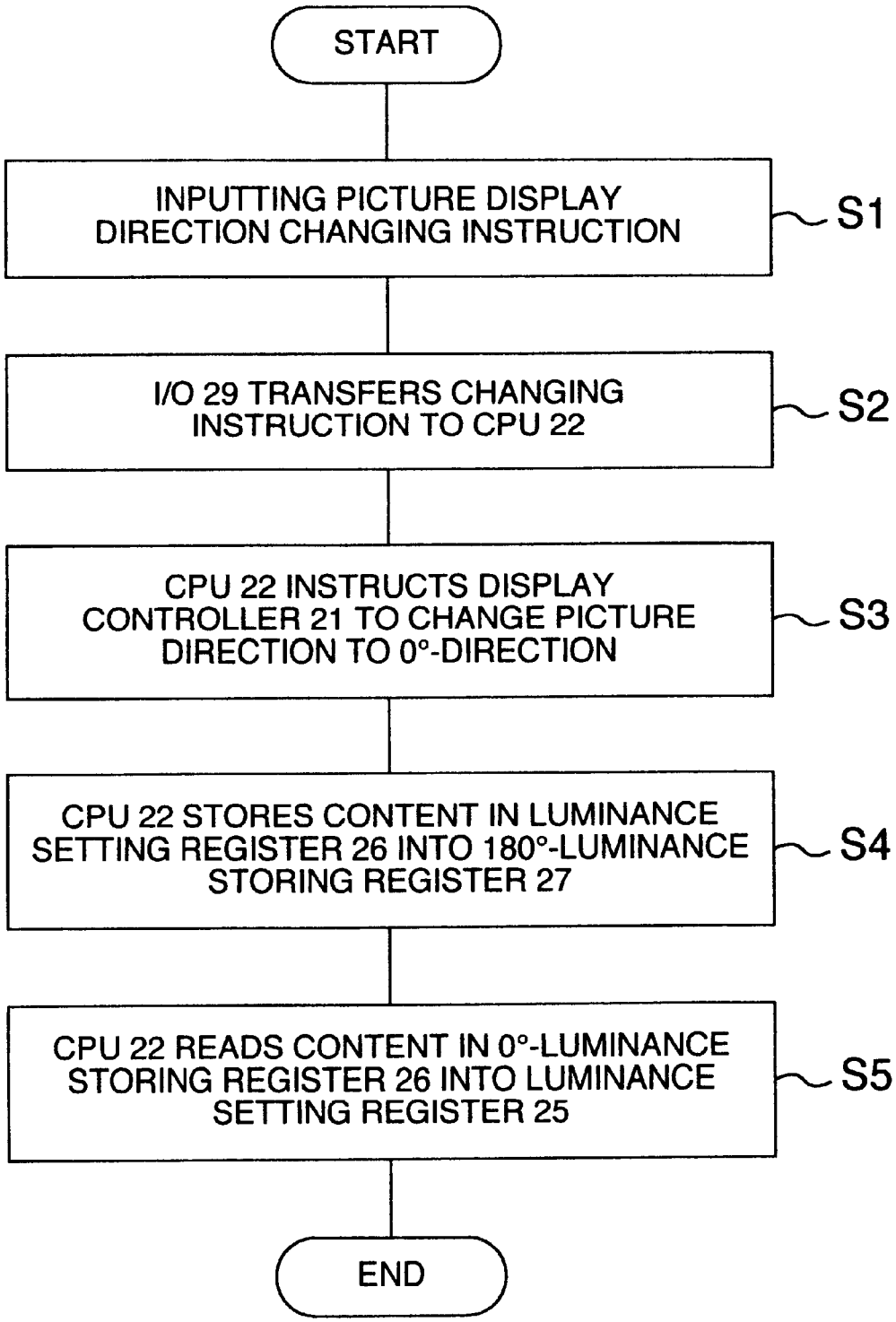
FIG. 8 is a flow chart for explaining the luminance adjustment processing at the time of the 0°-direction display in the embodiments according to the present invention.

FIG. 8 is a flow chart for explaining the above-described processing. When, at a step S1, the picture direction changing switch 31 issues the picture direction changing instruction, at a step S2, the I/O 29 transfers the changing instruction to the CPU 22. At a step S3, the CPU 22 issues, to the display LA controller 21, the instruction of switching the picture direction into the 0°-direction. At a step S4, the CPU 22 stores the content in the luminance setting register 25 into the 180°-luminance storing register 27. Finally, at a step S5, the CPU 22 sets the content in the 0°-luminance storing register 26 into the luminance setting register 25. Eventually, when changing the picture direction to the 0°-direction, this procedure changes the luminance to the content that had been stored in the 0°-luminance storing register 26, i.e., this procedure restores the luminance back to the original luminance.

Incidentally, in the above-described embodiments, the picture direction changing switch 31, the luminance increasing switch 41 and the luminance decreasing switch 42 are operated independently of each other. It is allowable, however, to give all these functions to the keyboard 5 and to implement the inputting by providing a special-purpose key or a combination inputting by existing keys. Also, it is allowable to employ a method of providing the D/A converter on the side of the fluorescent tube power-supply so as to immediately transfer the content in the luminance setting register 25 to the fluorescent tube power-supply. Also, by disabling the luminance adjustment performed by the luminance increasing switch 41 and the luminance decreasing switch 42 while the picture direction is being changed to the 180°-direction, when the picture direction is the 180°-direction, the luminance may be set to be a fixed value that depends on only the value in the 180°-luminance storing register. Moreover, concerning the switching of the picture display direction, at the time when open/close degrees of the liquid crystal display unit and the key inputting unit become larger than a predetermined open degree, i.e., for example, 180°, it is allowable to assume that the picture display direction changing instruction has been inputted. More concretely, in the case where the information processing apparatus according to the present embodiment is used in the face-to-face style so as to make a presentation, when opening and closing the display unit toward the facing person at the presentation, the upside-down inversion display of the displayed picture is executed and simultaneously with this, the display luminance is set to be a higher luminance.

Moreover, using FIG. 3, the explanation will be given below concerning still another embodiment. The information processing apparatus, in addition to the configuration components in FIG. 3, includes the power saving controlling unit 43. The power saving controlling unit 43, by monitoring an input frequency from the keyboard 5 and so on, detects an idle state of the information processing apparatus, and lowers and extinguishes the luminance of the backlight unit, thus reducing the power consumption in the information processing apparatus. When inverting the picture display by the amount of 180° so as to use the information processing apparatus for a presentation and so on, the input instruction from the picture direction changing switch 31 is supplied to the CPU 22. The CPU 22 issues the picture direction inverting instruction to the display controller 21, and changes the content in the luminance setting register 25 so as to set the luminance of the backlight unit 12 to be a luminance that is suitable for the 180°-inversion. In synchronization with this, the CPU 22 instructs the power saving controlling unit 43 to deactivate the function of performing the power saving control over the luminance of the backlight unit 12 and a power saving control over storage apparatuses such as a hard disk contained in the information processing apparatus. When restoring the picture display back to the 0°-direction, in synchronization with the 0°-direction restoring instruction of the displayed picture and the restoration of the luminance of the backlight unit 12, the CPU 22 instructs the power saving controlling unit 43 to activate the power saving control.

In the operation flow in FIG. 7 at the time of inverting the displayed picture by the amount of 180°, at the step 5, the CPU 22 instructs the procedure of reading the content in the 180°-luminance storing register 27 into the luminance setting register 25, and instructs the power saving controlling unit 43 to deactivate the power saving control.

In the operation flow in FIG. 8 at the time of restoring the picture display back to the 0°-direction, at the step 5, the CPU 22 instructs the procedure of reading the content in the 0°-luminance storing register 26 into the luminance setting register 25, and instructs the power saving controlling unit 43 to deactivate the power saving control.

Here, the following control is also allowable: The luminance setting register is not provided independently and the function thereof is shared by the power saving controlling unit, and the inputting from the picture direction changing switch 31 allows the power saving mode of the display unit to be changed. The above-described embodiment deactivates the power saving function while the 180°-inversion display of the displayed picture is being performed, thereby prohibiting the displayed picture from being extinguished during the execution of the presentation.

The present invention makes it possible to provide an information processing apparatus that exhibits an excellent visual recognizablity and is easy to use in the normal usage state and in the face-to-face usage state where the display direction of the picture is inverted by the amount of 180°.

What is claimed is:

1. The information processing apparatus having a liquid crystal display unit, comprising:

picture direction changing instruction inputting means for instructing change of a direction of character position displayed on said liquid crystal display unit, luminance adjusting means for setting a luminance of said liquid crystal display unit, and display unit controlling means for controlling a picture display direction in accordance with a picture display direction specified by said changing instruction inputting means and controlling said luminance adjusting means in such a manner as to be coupled with said controlling of said direction of character position, further comprising luminance storing means that includes a first storing unit for storing at least luminance information in a normal direction of character position and a second storing unit for storing luminance information in a character position upside-down inversion direction, and wherein, at the time of a displayed character position upside-down inversion, said display unit controlling means stores present luminance information into said first storing unit and reads, from said second storing unit, said luminance information at the time of said character position upside-down inversion, thereby setting said luminance adjusting means.

2. The information processing apparatus having a liquid crystal display unit, comprising:

picture direction changing instruction inputting means for instructing change of a direction of character position displayed on said liquid crystal display unit, luminance adjusting means for setting a luminance of said liquid crystal display unit, and display unit controlling means for controlling a picture display direction in accordance with a picture display direction specified by said changing instruction inputting means and controlling said luminance adjusting means in such a manner as to be coupled with said controlling of said direction of character position, further comprising luminance storing means that includes a first storing unit for storing at least luminance information in a normal direction of character position and a second storing unit for storing luminance information in a character position upside-down inversion direction, and wherein, at the time of a displayed character position upside-down inversion, said display unit controlling means stores present luminance information into said first storing unit and reads, from said second storing unit, said luminance information at the time of said character position upside-down inversion, thereby setting said luminance adjusting means, wherein, at the time of restoring from said displayed character position upside-down inversion state, said display unit controlling means stores said present luminance information into said second storing unit and reads, from said first storing unit, said luminance information at the time of said character position upside-down inversion, thereby setting said luminance adjusting means.

3. A display controlling method in an information processing apparatus having a liquid crystal display unit, comprising the steps of:

detecting an instruction of changing a direction of character position displayed on said liquid crystal display unit to an upside-down inversion display, transferring, to said liquid crystal display unit, display data the display direction of which has been inverted upside down, and setting a picture luminance of said liquid crystal display unit to be a higher luminance in comparison with a picture luminance in a normal character position direction, when changing said character position display direction to said upside-down inversion display, storing, into first luminance storing means, display luminance information of said display unit before said change, and making reference to display luminance information at the time of said upside-down inversion display which has been stored in second luminance storing means, and, based on said display luminance information, setting said luminance of said display unit, and, when restoring said character position display direction from said upside-down inversion display, storing, into said second luminance storing means, said display luminance information at the time of said upside-down inversion display, and making reference to said display luminance information before performing said upside-down inversion display which has been stored in said first luminance storing means, and, based on said display luminance information, performing a restoration of said luminance of said display unit.

* * * * *